US009550098B2

(12) United States Patent
Wahl et al.

(10) Patent No.: US 9,550,098 B2
(45) **Date of Patent: *Jan. 24, 2017**

(54) GOLF CLUB SHAFT

(71) Applicant: Taylor Made Golf Company, Inc., Carlsbad, CA (US)

(72) Inventors: Bret H. Wahl, Escondido, CA (US); Joshua J. Dipert, Carlsbad, CA (US); Ryuichi Sugimae, San Diego, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/793,018

(22) Filed: Jul. 7, 2015

(65) Prior Publication Data

US 2015/0306479 A1 Oct. 29, 2015

Related U.S. Application Data

(63) Continuation of application No. 14/109,605, filed on Dec. 17, 2013, now Pat. No. 9,155,946.

(60) Provisional application No. 61/738,802, filed on Dec. 18, 2012.

(51) Int. Cl.
*A63B 53/10* (2015.01)
*A63B 53/00* (2015.01)

(52) U.S. Cl.
CPC ..... *A63B 53/10* (2013.01); *A63B 53/00* (2013.01); *A63B 2053/002* (2013.01); *A63B 2209/00* (2013.01)

(58) Field of Classification Search
CPC ..... A63B 53/10; A63B 53/00; A63B 2209/00; A63B 2053/002
See application file for complete search history.

(56) References Cited

U.S. PATENT DOCUMENTS

| | | | | |
|---|---|---|---|---|
| 2,250,429 A | | 7/1941 | Vickery | |
| 5,236,198 A | | 8/1993 | Haines et al. | |
| 5,240,221 A | | 8/1993 | Thomasen | |
| 5,277,423 A | * | 1/1994 | Artus | A63B 60/54 473/310 |
| 5,297,791 A | | 3/1994 | Negishi | |
| 5,467,984 A | | 11/1995 | Veux et al. | |
| 5,685,781 A | | 11/1997 | Pedersen et al. | |
| 5,716,291 A | | 2/1998 | Morell et al. | |
| 5,943,758 A | | 8/1999 | Haas | |
| 8,491,411 B2 | | 7/2013 | DeShiell et al. | |

FOREIGN PATENT DOCUMENTS

GB 2313321 11/1999

* cited by examiner

*Primary Examiner* — Stephen Blau
(74) *Attorney, Agent, or Firm* — Klarquist Sparkman, LLP

(57) ABSTRACT

A golf club and golf club shaft includes a tubular member having at least one neck portion with a reduced outer diameter and at least one relatively rigid two-piece sleeve secured to the tubular member in overlying relationship to each neck portion. The two-piece sleeve defines a small central gap filled by a compressible ring to allow the two otherwise longitudinally aligned sleeve pieces to pivot relative to one another under dynamic loading of the tubular member during a golf swing, and then upon reaching a limit point restrict additional deflection or bending of the tubular member.

11 Claims, 6 Drawing Sheets

GOLF CLUB SHAFT

CROSS REFERENCE TO RELATED APPLICATION

This application is a continuation of U.S. patent application Ser. No. 14/109,605, filed Dec. 17, 2013, which claims priority to and benefit of U.S. Provisional Application No. 61/738,802, filed Dec. 18, 2012, both of which are incorporated herein by reference in their entirety.

FIELD

The present application relates to golf clubs and more particularly to golf club shafts that improve performance and mitigate the effects of droop during a golf swing.

BACKGROUND

During a golf swing, the golf shaft flexes or bows due to gravity and forces applied by the golfer to the club, especially longer clubs. During the initial phase of the downswing, the club shaft bows backwardly as the golfer's hands and grip end of the shaft accelerate, and the club is subject to centrifugal forces and bending moments. As the downswing continues, the center of gravity of the club head tries to catch up and align itself with the club shaft. Eventually the head accelerates past the nominal shaft axis so that at the point of impact the club shaft actually is bowed forwardly. To the extent this flexing is within the swing plane or hitting direction and creates forward deflection at impact, it has the desirable effect of increasing the "dynamic loft" of the club to cause a higher ball trajectory and imparting a greater force to the ball at impact.

"Dynamic loft" is the angle of the club face when it impacts the ball during the swing. In contrast, "grounded loft" or static loft is the loft angle of the club face when the clubhead is resting on the ground during set up. Thus, dynamic loft takes into account the static loft of the club, the attack angle of the swing, as well as the change in the orientation of the clubhead attributable to any bending of the shaft. For example, forward deflection of the shaft in the swing plane at the point of impact creates greater dynamic loft, causing a higher launch angle and ball trajectory for a given static loft of the club. With a traditional longer golf club and typical swing, the dynamic loft may be substantially greater than the club's static loft.

An additional dynamic effect occurring during a golf swing is shaft "droop." During the downswing, the club head accelerates toward the ball. As this happens, the centrifugal force of the downswing applied to the moment arm between the shaft axis and the center of gravity of the club head creates a torque force which causes the shaft to flex and bow downward, out of the swing plane. The resulting "droop" of the clubhead creates a flattening of the lie angle of the golf club of up to several degrees depending upon the location of the clubhead center of gravity, the speed of the swing (and the resultant magnitude of the centrifugal force), the length and flexibility of the shaft, and other factors. Shaft droop tends to open the club face at impact, causing a ball trajectory tendency to the right, and decreases the dynamic loft, both of which are undesirable.

In general, at the point of impact, the magnitude of the droop deflection of the club shaft is larger than its deflection in the swing plane, especially near the head where the shaft diameter is the smallest. This is attributable to the fact that the moment arm (i.e., distance between the shaft axis and the clubhead center of gravity) in the droop plane is typically larger than the moment arm in the swing plane. Both droop deflection and swing plane deflection are greater and more of a factor with longer clubs such as drivers, fairway woods and long irons because the head is at the end of a longer moment arm. They also are more of a factor with graphite shafts which generally are more flexible than steel shafts.

There remains a need for a golf club shaft that mitigates the effects of droop and improves club performance, especially in the context of clubs having composite (i.e., graphite) shafts.

SUMMARY

In one embodiment, the present disclosure describes a golf shaft comprising a substantially cylindrical shaft member having a tip end, butt end, tip section adjoining the tip end, butt section adjoining the butt end, and midsection therebetween, all formed substantially from graphite or other composite material.

According to one aspect of the disclosure, at least a portion of the tip section includes at least one neck portion of reduced outer diameter. A deflection limiting outer sleeve is bonded to an outer surface of the tip section and overlies the neck portion, the sleeve having a centrally located gap filled with a compressible material.

In one example, the sleeve is adhesively bonded to the shaft member.

In another example, a gap is defined along a portion of an interface between the outer sleeve and tip section.

In yet another example, the compressible material has an axial length of about 0.1 to 1.0 mm, such as about 0.25 to 0.50 mm, and is made from a material that is relatively more compressible than the material making up the deflection limiting outer sleeve. For example, the compressible material may comprise one or more of urethane, silicone, injectable rubber, polyurethane, viscoelastic elastomer, polybutadiene, polystyrene, polyisoprene, polyethylene, polyolefin, styrene/isoprene block copolymer, hydrogenated styrenic thermoplastic elastomer, natural or synthetic rubber, thermoset or thermoplastic rubber, foamed polymer, ionomer, and mixtures thereof.

In another aspect of the present disclosure, the shaft member is a hollow graphite tube, and at least one deflection limiting sleeve is bonded to an outer surface of the tube proximate to the tip end and overlying a first neck section of the tube. The sleeve preferably is formed from material having a stiffness sufficient to restrict local flexing of the tube and includes two pieces defining a gap therebetween filled with a compressible ring. The ring allows the sleeve pieces to pivot relative to one another when the tube deflects during dynamic loading and the ring compresses on one side of the tube.

In another example, the tube has a second neck portion proximate to but spaced from the first neck portion, and the outer sleeve overlies both the first and second neck portions.

In another example, the tube includes a second neck section proximate to the butt end, and the shaft includes a second deflection limiting sleeve bonded to an outer surface of the tube and overlying the second neck section.

In yet another aspect of the present disclosure, a golf club includes a hollow composite golf shaft having an outer diameter that generally tapers from a butt end of the shaft to an opposed tip end of the shaft. A club head is affixed to the shaft at the tip end. The shaft has at least a first neck to create at least a first localized flex zone. The shaft further includes a first deflection limiting sleeve affixed to an outer surface of the shaft in the area of the flex zone. The sleeve preferably overlies the first neck portion and extends beyond both ends of the neck. The first sleeve is formed from at least two sleeve sections, with the sleeve section being separated by a compressible ring therebetween.

According to another aspect of the present disclosure, the shaft has a second neck portion to create a second localized flex zone, and a second deflection limiting sleeve affixed to the outer surface of the shaft and overlying the second neck section. The first flex zone is located proximate to the tip end and the second flex zone is located proximate to the butt end.

In still another example of the present disclosure, a golf club includes a hollow shaft having a tip end and a butt end, the shaft having an outer wall that generally tapers from the butt end to the tip end. The club head is affixed to the tip end. The shaft includes at least one outer wall portion of reduced diameter to form a neck. An outer sleeve is bonded to the shaft in overlying relationship to the neck, and has at least two adjoining sections defining a gap therebetween. The gap is filled by a compressible material. The sleeve sections and compressible material allow the shaft to flex a predetermined amount during a golf swing to a limit point where the compressible material can compress no further and end portions of the sleeve sections effectively abut one another. The shaft preferably has a droop to dynamic loft ratio of 2:1 to 4:1 at the point of impact during a golf swing.

BRIEF DESCRIPTION OF THE DRAWINGS

The present invention is illustrated by way of example and not limitation in the figures of the accompanying drawings in which like references indicate similar elements. The figures are not necessarily to scale or intended to illustrate correct size proportions between components.

DETAILED DESCRIPTION

Various embodiments and aspects of the present invention will be described with reference to details discussed below, and the accompanying drawings will illustrate the various embodiments. The following description and drawings are illustrative of the invention and are not to be construed as limiting the invention. Numerous specific details are described to provide a thorough conceptual understanding of various embodiments of the present invention. However, in certain instances, well-known or conventional details are not described in order to provide a concise discussion of embodiments of the present inventions.

Figure 1:
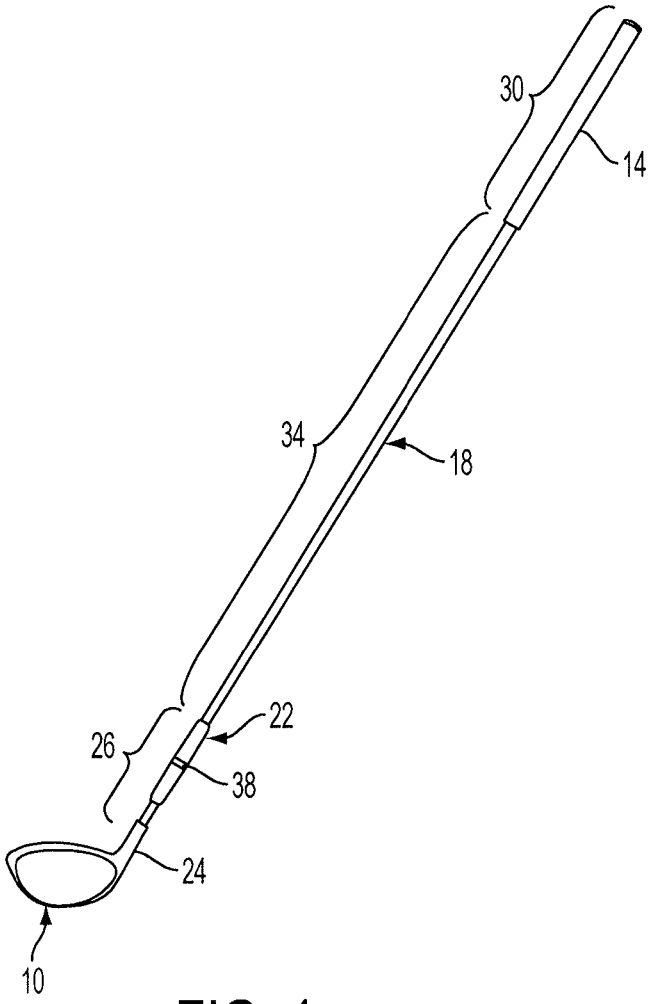
FIG. 1 is an illustration of an embodiment of a golf club according to the present disclosure.

FIG. 1 illustrates a golf club having a head 10, grip 14 and shaft 18 therebetween. An outer deflection limiting sleeve 22 is secured to the shaft 18 in the vicinity of the head 10.

The club and head illustrated in FIG. 1 is for a driver but it will be appreciated that the present disclosure is applicable to other types of clubs as well, especially longer clubs like fairway woods and long irons.

Unless otherwise noted, the shaft 18 is typical of conventional golf club shafts and has a hollow tubular body that generally tapers from its largest outer diameter at the grip end to its smallest outer diameter at the head end. The shaft 18 has a tip end that extends coaxially into a hosel portion 24 of the head 10 where it is secured to the head in any one of conventional manners. Opposite the tip end (hidden in FIG. 1), the shaft 18 has a butt end (also hidden) that terminates generally at the butt end of the grip. The shaft is coaxial with and extends into an opening in the grip 14 such that the butt end of the shaft inside the grip 14 butts up against the inner end of the grip. As FIG. 1 illustrates, the shaft 18 has a tip section 26 at one end that includes the lower end of the shaft and sleeve 22, butt section 30 that includes the grip 14, and midsection 34 therebetween.

Except as noted below, the tip section 26 of the shaft, including the extension within the hosel 24, has outer and inner walls of constant diameter such that the shaft has no overall taper. Similarly, the portion of the shaft 18 that is coaxial with the grip 14 and coextensive with the butt section 30 also has no taper. Like traditional shafts, the midsection 34 generally tapers from the butt section 30 to the tip section 26. In one example, the largest outer diameter of the shaft in the butt section (as well as the butt end of the midsection) is about 0.6 inches and the smallest outer diameter of the shaft in the tip section (excluding the neck portion to be described) is about 0.37 inches. Since the shaft has its smallest overall diameter in the tip section 26, this region is the most flexible portion of the shaft. In other embodiments, the butt section 30 and/or the tip section 26 may include a general taper as well.

As explained below, the present invention and exemplary embodiments described herein are especially suitable for composite shafts as, for example, graphite shafts. Graphite (and other composite) shafts generally are more flexible than the most common alternative type of shaft, steel shafts.

In the preferred embodiment shown in FIG. 1, the sleeve 22 is fixedly attached to the shaft 18 in the tip section 26 and proximate to but spaced from the end of the hosel portion 24. In one example, the lower end of the sleeve is attached about 1 to 7 inches from the tip end, and about 0 to 6 inches from the upper end of the hosel portion.

The sleeve 22 serves to restrict the amount of deflection, flexing or bowing of the shaft in the area of the tip section 26, where the shaft generally is most flexible. It will be appreciated however that benefits also may be obtained if the sleeve is attached near the butt section 30 and grip 14, or even in the midsection 34. Performance benefits also may be obtained if plural sleeves are attached to the shaft as, for example, in both the tip section 26 (as shown in FIG. 1) and near the grip 14, depending on the desired performance characteristics for the club and shaft.

Figure 2:
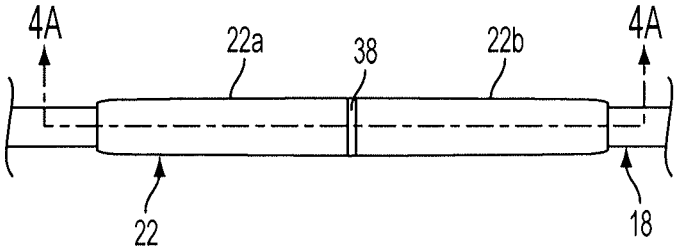
FIG. 2 is an enlarged side view of a portion of the golf club of FIG. 1

FIG. 2 is an enlarged side view of the sleeve 22. The sleeve is bonded or otherwise fixedly secured to an outer surface of the shaft 18 using for example an adhesive to bond the sleeve to the graphite shaft. Suitable adhesives or other bonding agents will depend on the material of the sleeve and shaft and may include, for example, high strength adhesives such as epoxy, polyurethane, acrylic, or cyanoacrylate adhesives. The adhesive preferably provides a secure bond using a relatively thin layer in order to inhibit or eliminate any slop or play in the bond between the shaft 18 and the sleeve 22.

The sleeve 22 preferably includes two tubular sleeve portions 22*a*, 22*b* separated by a small gap filled with a readily compressible material or ring 38, which is attached by bonding or otherwise to facing ends of sleeve portions 22*a*, 22*b*. The ring 38 is sandwiched between the two sleeve portions, and acts as a hinge to allow the sleeve portions to pivot or bend relative to one another about an axis passing through the ring.

The sleeve is a relatively hard, stiff material such as acrylonitrile butadiene styrene (ABS) plastic, polycarbonate, or composite (e.g., carbon fiber composite) material to allow minimal additional deflection of the shaft in the vicinity of the sleeve due to bending deformation of the sleeve portions themselves once the predetermined limit of shaft deflection is reached. Other suitable sleeve materials, which should be durable in a golf club environment and stiff enough to limit deflection or flexing of the shaft in the local vicinity of the sleeve, include metals (e.g., steel, aluminum, titanium, or others), metal alloys, other rigid polymeric or plastic materials, and the like. The sleeve has a wall thickness that is sufficient to provide the performance objectives described herein while also providing sufficient durability. For example, in an embodiment that includes sleeves formed of polycarbonate, the sleeve included a maximum wall thickness of about 1.5 mm, and an overall length of about 80 mm.

In contrast, the ring 38, which preferably extends 360 degrees around the shaft, is relatively soft and compressible. The ring serves primarily to fill the gap or space between the sleeve portions to allow them to pivot or bend relative to the longitudinal axis of the shaft. The ring preferably has a wall thickness that is relatively the same as, or comparable to, the wall thickness of the sleeve adjacent to the gap in which the ring 38 is located. For example, in some embodiments, the ring 38 has a wall thickness of about 0.1 to 2.0 mm, an axial length of about 0.1 to 1.0 mm and is made from a durable compressible material such as urethane, silicone, injectable rubber, polyurethane, viscoelastic elastomer, polybutadiene, polystyrene, polyisoprene, polyethylene, polyolefin, styrene/isoprene block copolymer, hydrogenated styrenic thermoplastic elastomer, natural or synthetic rubber, thermoset or thermoplastic rubber, foamed polymer, ionomer, and/or mixtures thereof. The axial length of the ring is dependent on the target performance characteristics for the shaft/club and especially how much shaft deflection is to be permitted in the local vicinity of the sleeve. For example, if the length (or thickness) of the ring is too great, the respective longitudinal axes of the sleeve portions may be able to pivot out of alignment during the swing and allow excessive bending of the shaft before the ends of sleeve portions reach the compression limit of the ring and effectively abut one another to limit further deflection. If the length or thickness of the ring is too small, the geometry is such that the sleeve portions will effectively abut one another too soon and allow an insufficient amount of deflection or bending of the shaft.

Generally, the axial length (or thickness) of the ring will be less than or equal to the wall thickness of the sleeve portions. However, the thickness of the ring may be greater than the wall thickness of the sleeve portions where the compressibility of the ring is such that it will reach its compression limit at the predetermined point of maximum permitted shaft deflection. Whether the geometry and compressibility is such that the sleeve portion ends come very close to actual contact with a relatively thin ring compressed therebetween, or the sleeve end portions are spaced farther apart when a relatively thick ring reaches its maximum compression limit, the sleeve end portions can be said to effectively abut one another at the deflection limit point.

Figure 3:
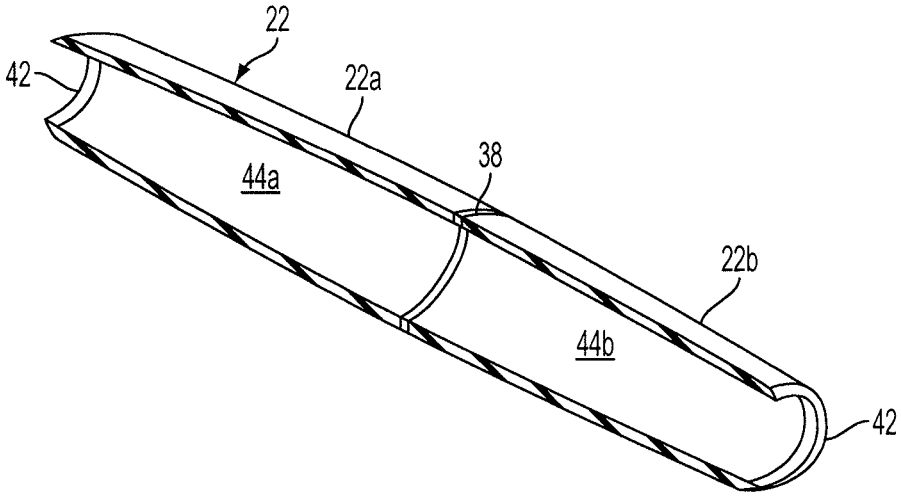
FIG. 3 is a cross sectional view of a sleeve element shown in FIGS. 1 and 2.

FIG. 3 shows that the outer sleeve 22 is a hollow tube formed by sleeve portions 22*a*, 22*b* which sandwich therebetween the compressible ring 38. The sleeve portions preferably have respective inner walls 44*a*, 44*b* of constant diameter and outer walls of constant diameter, except where the outer wall of the sleeve portions 22*a*, 22*b* tapers at ends 42 to provide a smooth, less abrupt surface transition with the shaft. At least a portion of inner walls 44*a*, 44*b* provide a bonding surface for adhesive or other bonding agents to coaxially attach the sleeve to the outer surface of the shaft.

Figure 4A:
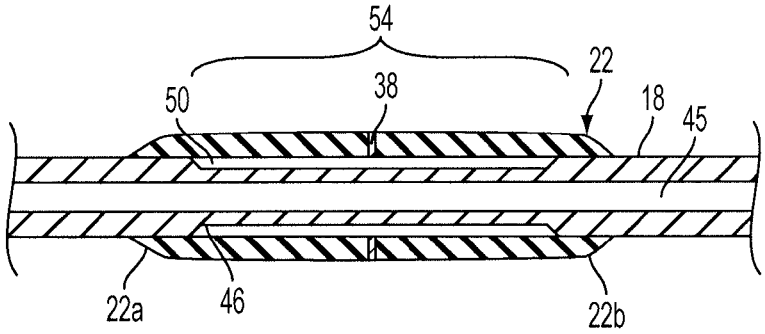
FIG. 4A is a cross sectional view taken along lines 4A-4A of FIG. 2.

Referring to FIG. 4A, shaft 18 has a bore 45 that is coaxial with a bore defined by sleeve 22. A portion of the shaft's tip section has a reduced outer diameter or neck portion 46. The sleeve 22 overlies the neck portion 46, with the ends of the sleeve preferably extending at least slightly beyond the neck portion. The neck portion creates an annular gap 50 between the outer wall of the neck portion and inner wall 44 (FIG. 3) of the sleeve 22. The neck portion 46 preferably is about 50 to 60 mm in length, but performance benefits still may be obtained if the neck length is shorter or longer. The reduced neck portion in the tip section makes the shaft 22 more flexible in an area of the shaft that already is relatively flexible due to its smaller outer diameter compared to the rest of the shaft. At the same time, the sleeve 22 counters or offsets this flexibility in the same area by limiting or restricting the amount of shaft deflection/bending that is permitted during the golf swing. While the tip section is able to deflect more easily when subject to dynamic loading during the swing, the sleeve limits the deflection to a predetermined maximum amount.

Figure 4B:
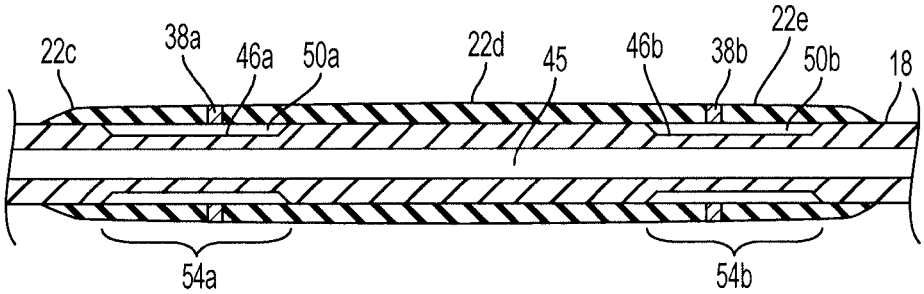
FIG. 4B is a cross sectional view similar to FIG. 4A but of a second embodiment.

An alternate embodiment having two spaced apart neck portions 46*a*, 46*b* is illustrated in FIG. 4B. A single sleeve 22 coaxially overlies both neck portions 46*a*, 46*b* and extends just beyond the opposite ends of the neck portions. The sleeve 22 of FIG. 4B has three sleeve portions or sections 22*c*, 22*d*, 22*e* separated by two compressible rings 38*a*, 38*b*, and defines two gaps 50*a*, 50*b*. In one example, the sleeve has a length of about 75 mm to about 150 mm, each neck portion has a length of about 15 to 50 mm, and the two neck portions are spaced apart by about 10 to 20 mm. In contrast to the sleeve of FIG. 4A which cooperates with one neck portion to create a single flex zone 54, the sleeve of FIG. 4B cooperates with two neck sections to create two closely adjacent flex zones 54*a*, 54*b*. Much like the embodiment of FIG. 4A, the sleeve sections 22*c*, 22*d*, 22*e* are aligned and share a common longitudinal axis when the club and shaft are at rest. During the downswing of the club, however, when bending moments cause the shaft to bend, sleeve sections 22*c*, 22*e* pivot out of alignment relative to section 22*d*, until rings 38*a*, 38*b* reach their compression limit and sections 22*c*, 22*e* effectively abut section 22*d* to stop further local deflection of the shaft 18 in the area near the club head.

In yet another embodiment (not shown), the sleeve can be formed from sleeve portion 22*b* and hosel 24, with hosel 24 serving the function of both a traditional hosel and sleeve portion 22*a*. In this embodiment, the ring 38 is bonded to and located between the end of the hosel and sleeve 22*b*. Since hosel 24 is by its nature a stiff extension of the club head, it can serve to restrict deflection of the shaft tip portion located coaxially within the hosel and still allow sleeve portion 22*b* to pivot about the compression ring and yet provide a limit point for the amount of shaft deflection.

Figure 5A:
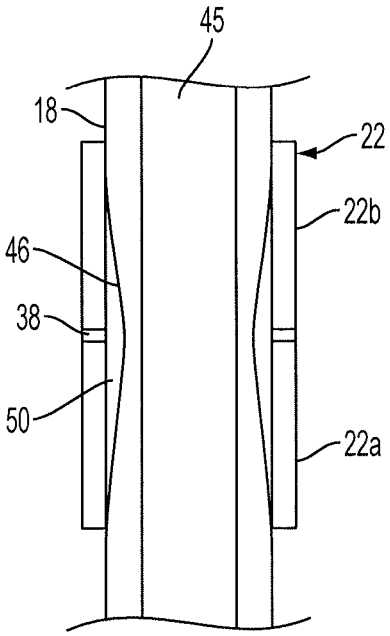
FIG. 5A is a schematic illustration of the sleeve element when the club shaft is straight or at rest.
Figure 5B:
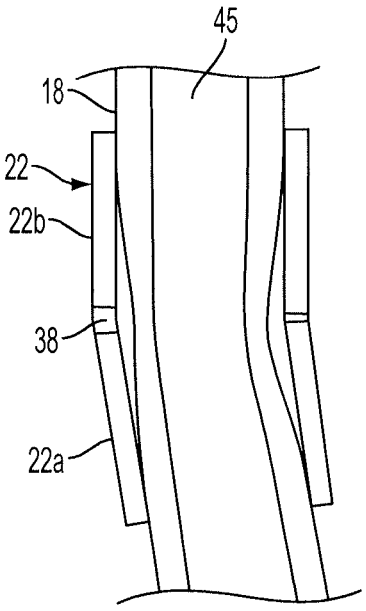
FIG. 5B is an illustration of the sleeve element under dynamic loading when the club shaft is flexed to its limit point.

FIGS. 5A and 5B are schematic illustrations showing sleeve 22 when the golf club is at rest (FIG. 5A) and when the club is bowing or deflecting during a golf swing (FIG. 5B). As a bending moment is applied to the shaft due to forces generated by the golf swing, the shaft 18 bends, creating compression loading on one side of the shaft and tensile loading on the other side of the shaft. Such loading causes one side of the sleeve's ring 38 to expand and the other side to compress. The compression side of the ring compresses until the adjacent ends of the sleeve portions 22*a*, 22*b* effectively abut one another to prevent further deflection of the shaft in that area. The sleeve acts as a regulator to mitigate, control or limit the amount of shaft deflection that may occur during the golf swing.

Figure 6:
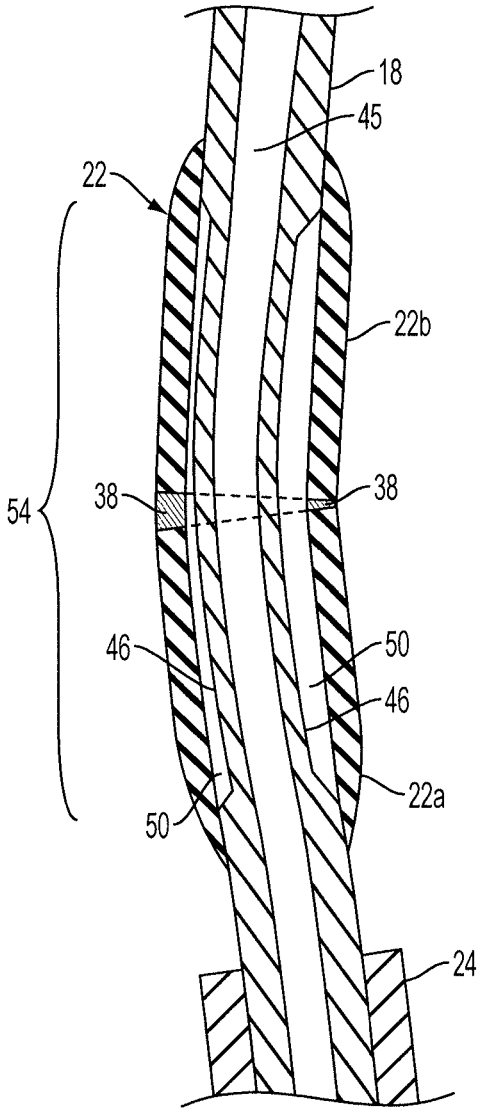
FIG. 6 is an enlarged, more detailed illustration of FIG. 5B.

FIG. 6 is a more detailed illustration of the sleeve 22 in a dynamic mode at a point of maximum shaft deflection during the downswing. In FIG. 6, the ring 38 is illustrated at its compression limit point with sleeves 22*a*, 22*b* effectively abutting one another on the compression side of the ring, thereby providing a stop or limit point for deflection of the shaft. It can be seen that the longitudinal axes of sleeve portions 22*a*, 22*b* are no longer aligned as the sleeve portions pivot relative to one another, causing compression on one side of the ring and tension on the other side of the ring.

While not bound by any theory, it is believed that the reduced-diameter neck portion makes the shaft more flexible, especially in the tip section of the shaft. The additional flexibility creates a greater backward deflection of the shaft in the swing plane during the downswing as the hands and grip accelerate sooner and faster than the head at the other end of the shaft, as well as a correspondingly greater positive forward deflection (i.e., rebound deflection) in the swing plane (or hitting direction) at the point of impact. The added flexibility also creates greater undesirable droop deflection.

The forward deflection caused by the shaft recoiling and the head accelerating past the hands at impact creates greater desirable dynamic loft (i.e., higher launch angle) and greater force applied to the ball due to the forward deflection of the shaft in the hitting direction. It is believed that the dynamic loft may be increased by up to three degrees. Despite the undesirable increase in droop (due to the tapered neck and additional flexibility), a significant overall performance benefit is achieved nonetheless because the deflection restriction sleeve limits or restricts the amount of droop outside the swing plane, and yet produces little or no restriction in the amount of desirable deflection in the hitting direction or swing plane, because droop deflection tends to be much larger than hitting direction deflection at the time of impact.

In this regard, it is believed that the shaft and system described herein can improve performance by reducing the ratio of droop to dynamic loft from about 5:1 and above for typical graphite shafts to a more favorable 4:1 to 2:1.

Figure 7:
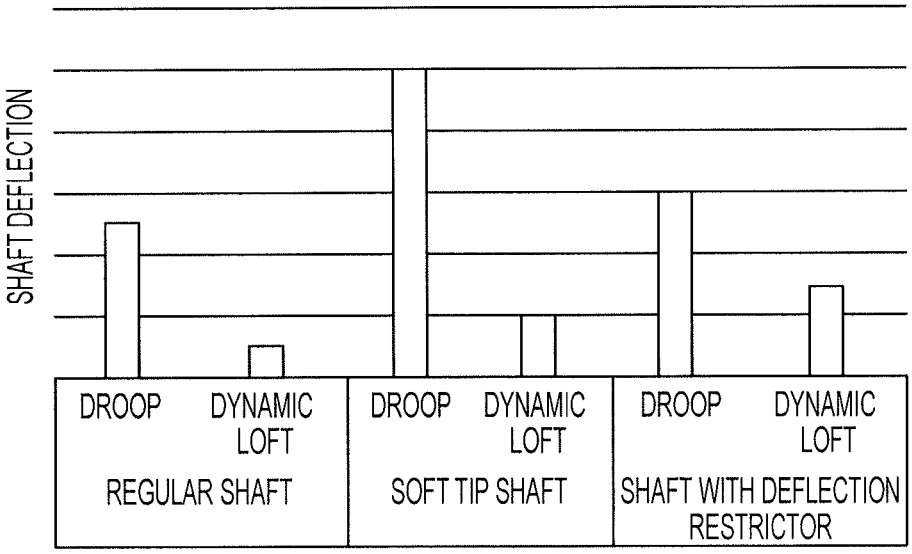
FIG. 7 is an illustrative table generally comparing droop and dynamic loft with different shafts.

As FIG. 7 illustrates, the droop of an exemplary graphite shaft made in accordance with the present disclosure is greater than the droop of a typical regular shaft (but less than a typical soft tip graphite shaft). However, the dynamic loft of the shaft described herein is greater than that of both a regular shaft and soft tip shaft. And most importantly, the ratio of droop to dynamic loft is less (i.e., closer to 1:1) with the shaft described herein than it is with a regular shaft or soft tip shaft.

It will be appreciated that with the novel concepts described herein, it is possible to fine tune and customize performance characteristics for different shafts depending on the desired objectives. For example, the shaft can be necked down in the midsection and/or butt section of the shaft. The deflection restriction sleeve can be bonded to the outer surface of the shaft to overlie a single "neck" section or overlie two or more neck sections. The length of the neck section(s) and sleeve(s) can be varied depending on desired target characteristics for the club. Similarly, the rigidity of the sleeve, compressibility of the ring and size of the gap between the sleeve portions can be adjusted to cause more or less restriction of the shaft's deflection.

A shaft in accordance with the present disclosure may be formed by starting with a conventional graphite or other composite shaft, using a lathe to create the neck portion(s) by removing material at the desired location(s) on the shaft, and then bonding the outer sleeve(s) over the neck portion (s). The head and grip are then attached to the shaft once the sleeve(s) has been affixed to the shaft. Alternatively, the neck portion(s) may be created through a "layup" approach as the shaft is manufactured by adding fewer graphite or other composite layers to the core in the area where the neck portion(s) is to be formed.

It will be appreciated that while the disclosed embodiments are especially well-suited for graphite shafts, they may be used beneficially with other relatively flexible shafts made from other composite material, steel or other materials.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf shaft comprising:

an elongate substantially cylindrical shaft member having a tip end and butt end;

the shaft member including a tip section adjoining the tip end, butt section adjoining the butt end and midsection therebetween, the tip section, butt section and midsection being formed at least partially from composite material;

at least a portion of the tip section having at least one reduced neck portion; and a deflection limiting outer sleeve which is bonded to an outer surface of the tip section and overlies the neck portion, the sleeve having a centrally located gap filled with a compressible material, and the gap extends 360 degrees around the sleeve.

2. The shaft of claim 1 wherein the neck portion is spaced about 1 to 7 inches from the end of the shaft.

3. The shaft of claim 1 wherein the tip section, butt section and midsection are hollow and made substantially of graphite material.

4. The shaft of claim 1 wherein the outer sleeve has a length of about 50 to 150 mm.

5. The shaft of claim 1 wherein the outer sleeve is adhesively bonded to the tip section.

6. The shaft of claim 1 wherein a gap is defined along a portion of an interface between the outer sleeve and tip section.

7. The shaft of claim 1 wherein the outer sleeve comprises a material taken from the group of acrylonitrile butadiene styrene (ABS) plastic, polycarbonate, composite, steel, aluminum, and titanium.

8. The shaft of claim 1 wherein the compressible material is a ring comprising a material taken from the group of urethane, silicone, injectable rubber and polyurethane, viscoelastic elastomer, polybutadiene, polystyrene, polyisoprene, polyethylene, polyolefin, styrene/isoprene block copolymer, hydrogenated styrenic thermoplastic elastomer, natural or synthetic rubber, thermoset or thermoplastic rubber, foamed polymer, and ionomer.

9. The shaft of claim 1 wherein the compressible material has an axial length of about 0.1 to 1.0 mm.

10. A golf shaft comprising:

a hollow graphite tube having a tip end and butt end;

the tube having a first neck section;

a first deflection limiting sleeve bonded to an outer surface of the tube overlying the first neck section;

the sleeve being formed of a material having a stiffness sufficient to restrict local flexing of the tube, and having a centrally located gap extending 360 degrees around the sleeve filled with a compressible material to allow portions of the sleeve on opposite sides of the gap to pivot relative to one another as the compressible material compresses.

11. The shaft of claim 10 wherein the tube includes a second neck section proximate to the butt end, and the shaft includes a second deflection limiting sleeve bonded to an outer surface of the tube and overlying the second neck section.

* * * * *